US006289648B1

(12) United States Patent
Freshwater et al.

(10) Patent No.: US 6,289,648 B1
(45) Date of Patent: Sep. 18, 2001

(54) LAMINATED ROOFING SHINGLE

(75) Inventors: John G. Freshwater, Bakersfield, CA (US); Willard Calvin Hudson, Jr., Arlington, TX (US); Clark Daniel Maytubby, Hanford, CA (US); Larry Scott Reed, Bakersfield, CA (US); Frank Clydean Richey, Bakersfield, CA (US); Michael Allen McLintock, Grapevine, TX (US)

(73) Assignee: Elk Corporation of Dallas, Dallas, TX (US)

( * ) Notice: Subject to any disclaimer, the term of this patent is extended or adjusted under 35 U.S.C. 154(b) by 0 days.

(21) Appl. No.: 09/401,392

(22) Filed: Sep. 22, 1999

(51) Int. Cl.[7] ..... E04D 1/28

(52) U.S. Cl. ..... 52/557; 52/314; 52/518; 52/554

(58) Field of Search ..... 52/314, 315, 318, 52/554, 557, 518

(56) References Cited

U.S. PATENT DOCUMENTS

| | | | |
|---|---|---|---|
| D. 309,027 | 7/1990 | Noone et al. . | |
| D. 344,144 | 2/1994 | Weaver et al. | D25/139 |
| 1,722,702 | 7/1929 | Kirschbraun et al. . | |
| 1,840,997 | 1/1932 | Yeager . | |
| 3,624,975 | 12/1971 | Morgan et al. . | |
| 3,921,358 | 11/1975 | Bettoli . | |
| 4,010,590 | 3/1977 | Reinke . | |
| 4,292,780 | 10/1981 | Barker et al. . | |
| 4,333,279 | 6/1982 | Corbin et al. . | |
| 4,391,076 | 7/1983 | Ferguson . | |
| 4,399,186 | 8/1983 | Lauderback . | |
| 4,405,680 | 9/1983 | Hansen . | |
| 4,434,589 | 3/1984 | Freilborg . | |
| 4,439,955 | 4/1984 | Freilborg . | |
| 4,459,788 | 7/1984 | Bockwinkel et al. . | |
| 4,717,614 | 1/1988 | Bondoc et al. . | |
| 4,825,616 | 5/1989 | Bondoc et al. . | |
| 5,181,361 | 1/1993 | Hannah et al. . | |
| 5,232,530 | 8/1993 | Malinquist et al. . | |
| 5,287,669 | 2/1994 | Hannah et al. . | |
| 5,369,929 | 12/1994 | Weaver et al. . | |
| 5,375,491 | 12/1994 | Hannah et al. . | |
| 5,400,558 | 3/1995 | Hannah et al. . | |
| 5,421,134 | 6/1995 | Hannah et al. . | |
| 5,501,056 | 3/1996 | Hannah et al. . | |
| 5,611,186 | 3/1997 | Weaver . | |
| 5,666,776 | 9/1997 | Weaver et al. . | |
| 6,014,847 * | 1/2000 | Phillips | 52/557 X |

* cited by examiner

*Primary Examiner*—Robert W. Gibson, Jr.
(74) *Attorney, Agent, or Firm*—Baker Botts L.L.P.

(57) ABSTRACT

There is provided a laminated roofing shingle having a first shingle sheet and a second shingle sheet. The first shingle sheet has a headlap section and a buttlap section, the buttlap section being about 7 inches or greater in height and including a plurality of tabs which are spaced apart to define one or more openings between the tabs. Each of the tabs has a relatively uniform color throughout the tab. The second shingle sheet is attached to the underside of the first shingle sheet and has portions exposed through the openings between the tabs. The second shingle sheet has at least first, second, third, and fourth horizontal striations thereon across at least partial portions of the second sheet which are exposed through the openings between the tabs. The first striation includes a first elongated quadrilateral area with a substantially uniform dark color throughout the first quadrilateral area. The second striation includes a second elongated quadrilateral area below the first striation. The second striation has a substantially uniform color throughout the second quadrilateral area. The third striation includes a third elongated quadrilateral area below the second striation. The third striation has a substantially uniform color throughout the third quadrilateral area, which is lighter than the color of the second striation. The fourth striation includes a fourth elongated quadrilateral area below the third striation. The fourth striation has a substantially uniform color throughout the fourth quadrilateral area, which is lighter than the color of the third striation. There are also provided methods for manufacturing the above-described laminated shingle.

10 Claims, 5 Drawing Sheets

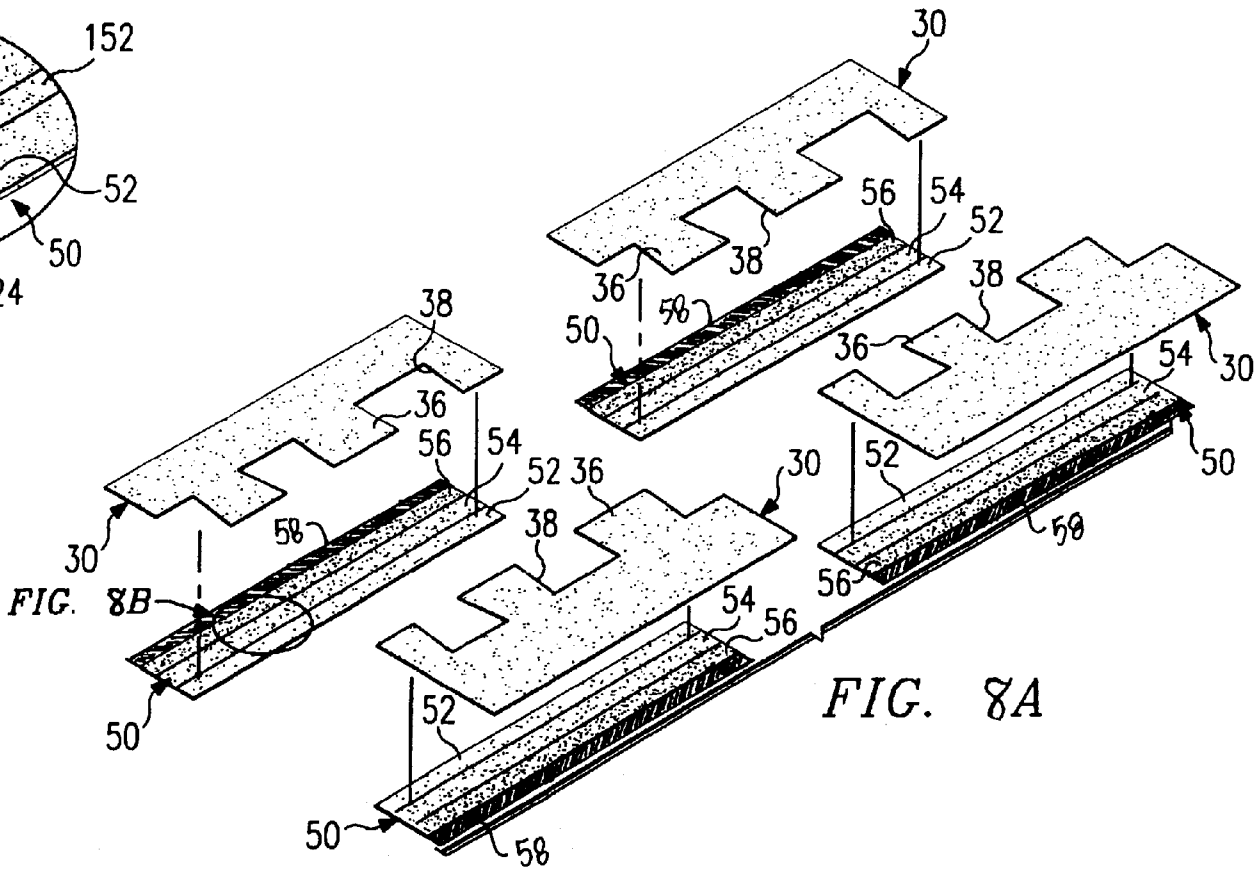
FIG. 8A
FIG. 8B
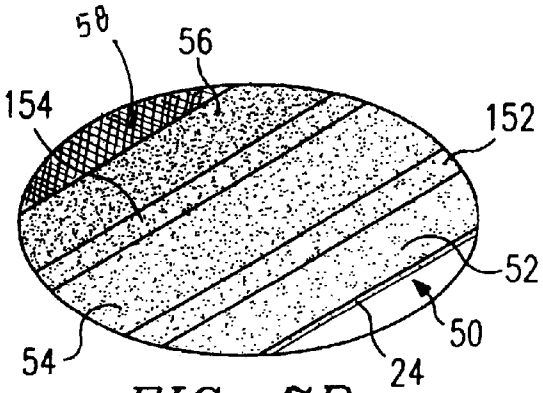

LAMINATED ROOFING SHINGLE

BACKGROUND

The present invention relates generally to the construction of a roofing shingle. In particular, the present invention relates to the construction of an asphalt roofing shingle utilizing a unique combination of exposure dimension and arrangement of color striations thereon to create a greater visual impact than existing asphalt shingles.

Asphalt shingles (sometimes also often referred to as composite shingles) are one of the most commonly used roofing materials. Asphalt shingles typically comprise an organic felt or fiberglass mat base on which is applied an asphalt coating. The organic felt or fiberglass mat base gives the asphalt shingle the strength to withstand manufacturing, handling, installation and servicing, and the asphalt coating provides resistance to weathering and stability under temperature extremes. An outer layer of mineral granules is also commonly applied to the asphalt coating to form a weather surface which shields the asphalt coating from the sun's rays, adds color to the final product, and provides fire resistance.

Asphalt shingles are typically manufactured as strip shingles, laminated shingles, interlocking shingles, and large individual shingles in a variety of weights and colors. Even though asphalt shingles offer significant cost, service life, and fire resistance advantages over wood shingles, wood shingles are often preferred due to their pleasing aesthetic features, such as their greater thickness as compared to asphalt shingles, which results in a more pleasing, layered look for a roof.

Various asphalt shingles have been developed to provide an appearance of thickness comparable to wood shingles. Examples of such asphalt shingles are shown in U.S. Pat. No. 5,232,530 entitled "Method of Making a Thick Shingle"; U.S. Pat. No. 3,921,358 entitled "Composite Shingle"; U.S. Pat. No. 4,717,614 entitled "Asphalt Shingle"; and U.S. Pat. Des. No. D309,027 entitled "Tab Portion of a Shingle." Each of these patents is incorporated by reference herein in its entirety.

In addition to these patents, significant improvements in the art of roofing shingles have been disclosed and patented in U.S. Pat. Nos. 5,369,929; 5,611,186; and 5,666,776; each entitled "Laminated Roofing Shingle", issued to Weaver et al. and assigned to the Elk Corporation of Dallas. These patents disclose laminated roofing shingles having a color gradient or gradation thereon to create the illusion of thickness or depth on a relatively flat surface. These patents are also incorporated by reference herein in their entireties. The present invention substantially improves on the roofing shingles described in the above-identified patents.

SUMMARY OF THE INVENTION

According to the present invention, there is provided a roofing shingle that includes a unique combination of exposure dimension and arrangement of color striations thereon to provide a greater visual impact than existing asphalt shingles. In accordance with one aspect of the present invention, there is provided a laminated roofing shingle having a first shingle sheet and a second shingle sheet. The first shingle sheet has a headlap section and a buttlap section, the buttlap section being about 7 inches or greater in height and including a plurality of tabs which are spaced apart to define one or more openings between the tabs. Each of the tabs has a relatively uniform color throughout the tab. The relatively uniform color throughout the tab may very in contrast between each of the tabs. The second shingle sheet is attached to the underside of the first shingle sheet and has portions exposed through the openings between the tabs. The second shingle sheet has at least first, second, third, and fourth horizontal striations thereon across at least partial portions of the second sheet which are exposed through the openings between the tabs. The first striation has a substantially uniform dark color throughout a first quadrilateral area. The second striation includes a second elongated quadrilateral area below the first striation. The second striation has a substantially uniform color throughout the second quadrilateral area. The third striation includes a third elongated quadrilateral area below the second striation. The third striation has a substantially uniform color throughout the third quadrilateral area, which is lighter than the color of the second striation. The fourth striation includes a fourth elongated quadrilateral area below the third striation. The fourth striation has a substantially uniform color throughout the fourth quadrilateral area, which is lighter than the color of the third striation. At least the second, third, and fourth striations provide a color gradation on at least partial portions of the second sheet which are exposed through the openings between the tabs. The color of the first striation may be selected to be consistent with (i.e., to continue) the color gradation of the second through fourth striations.

Other aspects of the present invention include methods for manufacturing the above-described laminated shingle.

BRIEF DESCRIPTION OF THE DRAWINGS

Exemplary embodiments of the present invention will now be described in detail with reference to the accompanying drawings in which:

FIG. 8A is an exploded isometric view showing shingle components taken from a sheet of roofing material according to another embodiment of the present invention; and FIG. 8B is an enlarged drawing of a portion of a backer strip of FIG. 8A with transition stripes disposed between adjacent horizontal striations.

DETAILED DESCRIPTION OF THE INVENTION

Figure 1:
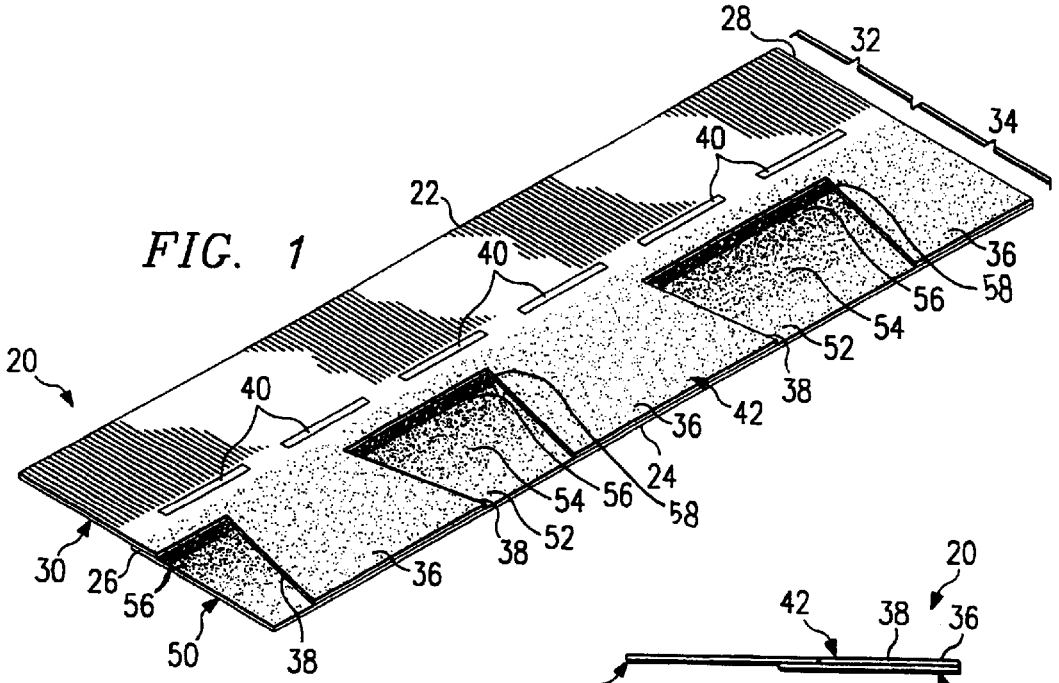
FIG. 1 is a perspective view of a laminated shingle incorporating one embodiment of the present invention.
Figure 4:
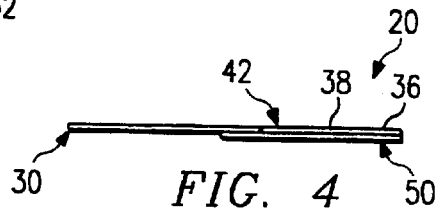
FIG. 4 is a left side view of the shingle of FIG. 1.
Figure 2:
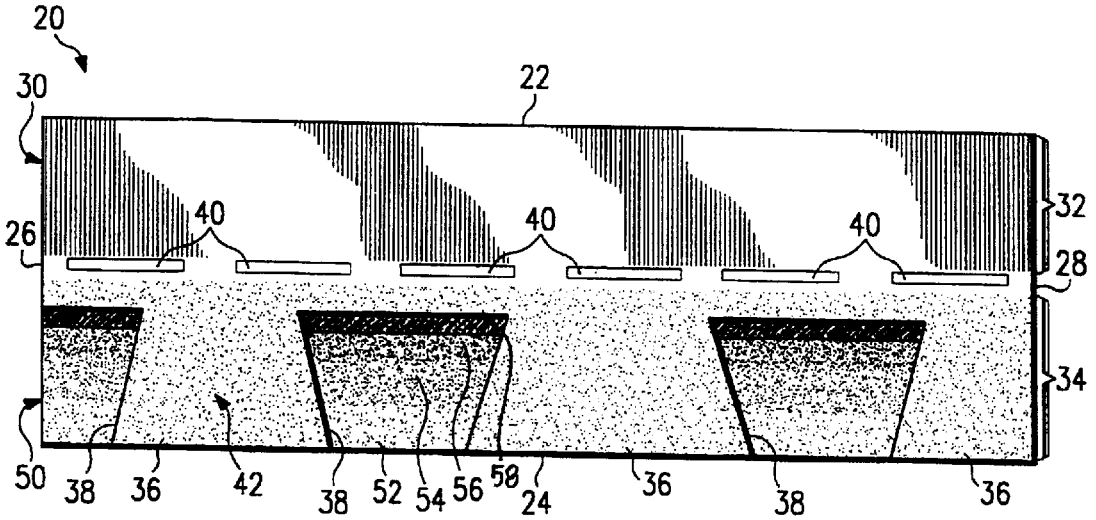
FIG. 2 is a top plan view of the shingle of FIG. 1.
Figure 3:
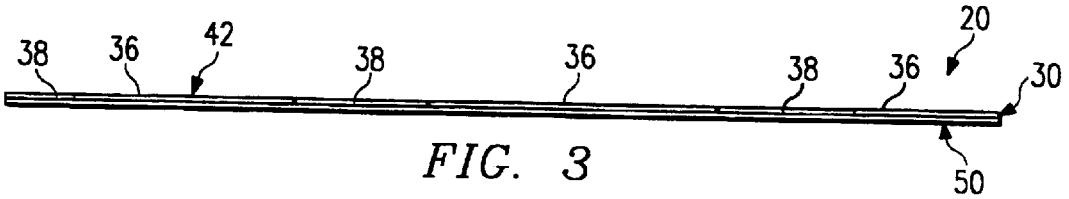
FIG. 3 is a front plan view of the shingle of FIG. 1.

A laminated shingle 20 according to an exemplary embodiment of the present invention is shown in FIGS. 1 to 4. The laminated shingle 20 preferably comprises a first shingle sheet 30 attached to a second shingle sheet 50. First shingle sheet 30 has a generally rectangular configuration defining a headlap section 32 of the laminated shingle 20, with a plurality of tabs 36 extending therefrom to define a buttlap section 34 of the laminated shingle 20. Tabs 36 may also be referred to as "dragon teeth." A plurality of openings 38 are formed between adjacent tabs 36. The second shingle sheet 50 also has a generally rectangular configuration and is disposed beneath tabs 36 with portions of the second shingle sheet 50 exposed through the plurality of openings 38.

Various techniques such as glueing or self-sealing adhesive strips (not shown) may be used to attach the second shingle sheet 50 to the underside of the first shingle sheet 30. The resulting laminated shingle 20 has a generally rectangular configuration defined in part by longitudinal edges 22 and 24 with lateral edges 26 and 28 disposed therebetween. Longitudinal edge 22 is defined by an end of headlap section 32 and constitutes the upper edge of the laminated shingle 20. Longitudinal edge 24 is defined by an end of buttlap section 34 and constitutes the lower (or leading) edge of laminated shingle 20. A plurality of self sealing adhesive strips 40 are preferably disposed on the exterior of first shingle sheet 30 between headlap section 32 and buttlap section 34.

First shingle sheet 30 may sometimes be referred to as a "tab sheet" or a "dragon tooth sheet," and second shingle sheet 50 may sometimes be referred to as a "backer strip" or "shim." In addition, openings 38 formed between adjacent tabs 36 with portions of backer strip 50 disposed thereunder may sometimes be referred to as "valleys." Depending upon the desired application and appearance of each laminated shingle 20, tabs 36 may have equal or different widths and may have a square, rectangular, trapezoidal, or any other desired geometric configuration. In the same respect, openings 38 may have equal or different widths and may have a square, rectangular, trapezoidal or any other desired geometric configuration. As will be explained later in more detail, laminated shingles 20 may be formed from a sheet 80 of roofing material shown in FIG. 6 with tabs 36 and opening 38 formed as a "reverse image" of each other.

For one embodiment of the present invention, laminated shingle 20 may be formed from a fiberglass mat (not shown) with an asphalt coating on both sides of the mat. If desired, the present invention may also be used with shingles formed from organic felt or other types of base material. The present invention is not limited to use with shingles having a fiberglass mat.

The exposed outer surface or weather surface 42 for shingle 20 is defined in part by tabs 36 and the portions of backer strip 50 which are exposed through openings 38 between adjacent tabs 36. Weather surface 42 of laminated shingle 20 may be coated with various types of mineral granules to protect the asphalt coating, to add color to laminated shingle 20 and to provide fire resistance. For some applications, ceramic coated mineral granules may be used to form the outer layer comprising weather surface 42. Also, a wide range of mineral colors from white and black to various shades of red, green, brown and any combination thereof may be used to provide the desired color for shingle 20. The underside of shingle 20 may be coated with various inert minerals with sufficient consistency to seal the asphalt coating.

According to the present invention, the buttlap section 34 (the exposed section of the shingle when it is laid up on a roof) is made about 7 inches or greater and four or more horizontal striations are provided on the surface of backer strip 50 which is exposed through openings 38. The horizontal striation nearest the headlap section of the shingle is made a uniformly dark color. Other horizontal striations are each made of a uniform color which together provide a color gradient or gradation according to the teachings of U.S. Pat. Nos. 5,369,929; 5,611,186; and 5,666,776, which are incorporated herein by reference in their entireties. The color of the striation nearest the headlap section may be selected to be consistent with (i.e., to continue) the color gradation of the other horizontal striations.

Using the foregoing unique combination of buttlap section (exposure) dimension and arrangement of color striations, the laminated shingle according to the present invention provides a significantly greater visual appearance than existing laminated shingles. While the improvement in visual appearance is applicable to all types of roofs, it is especially significant on low-sloped roofs (i.e., those roofs having less than six feet of rise for every twelve feet of run).

While many different shingle dimensions may be utilized with the present invention, the following exemplary dimensions and number of shingles per square are suitable for easy handling and packaging of the shingles:

1. 38 inch length, 7.9 inch exposure height, 17.8 inch overall height, and 48 shingles/square;
2. 36 inch length, 8 inch exposure height, 18 inch overall height, and 50 shingles/square;
3. 36 inch length, 8.3 inch exposure height, 18.6 inch overall height, and 48 shingles/square; and
4. 36 inch length, 9 inch exposure height, 20 inch overall height, and 44 shingles/square.

Returning to FIGS. 1 through 4, the exemplary embodiment shown includes a backer strip 50 with four horizontal striations 52, 54, 56, and 58. Striation 58, the striation adjacent the headlap section of the shingle, is a uniformly dark-colored striation. The horizontal striations 52, 54, and 56 are colored striations that provide a color gradient or gradation from a light color near the leading edge 24 to a dark color near the upper portion of each opening 38. The color of the horizontal striation 58 may be selected to be consistent with (i.e., to continue) the color gradient or gradation of the other striations (so that striations 52 through 58 altogether provide a color gradient or gradation). Preferably, the height of each striation is approximately equal. In addition, for aesthetic reasons it is preferred that the height of each striation be in the range of one to two inches.

The number of horizontal striations and the width of each striation on backer strip, 50 may be varied depending upon the desired aesthetic appearance of the resulting laminated shingle 20. It is preferred, however, for a shingle to have an exposure height of 7 to 9 inches and four to six horizontal striations thereon.

Each striation may have a different color to establish the desired amount of contrast. For the purposes of this patent application, a different color may include a different tone. In addition, contrast for purposes of this patent application is defined as the degree of difference in the tone or shading between areas of lightest and darkest color. For some applications, a gradual change in contrast associated with a large number of striations may provide the appearance of depth or thickness associated with wood or other natural products. Also, the amount or degree of contrast in the color gradient exposed in each opening 38 may be varied depending upon the desired aesthetic appearance. An important feature of the present invention is the ability to vary the color gradient and the amount of contrast to provide the desired illusion or appearance of thickness on the finished roof.

Figure 5:
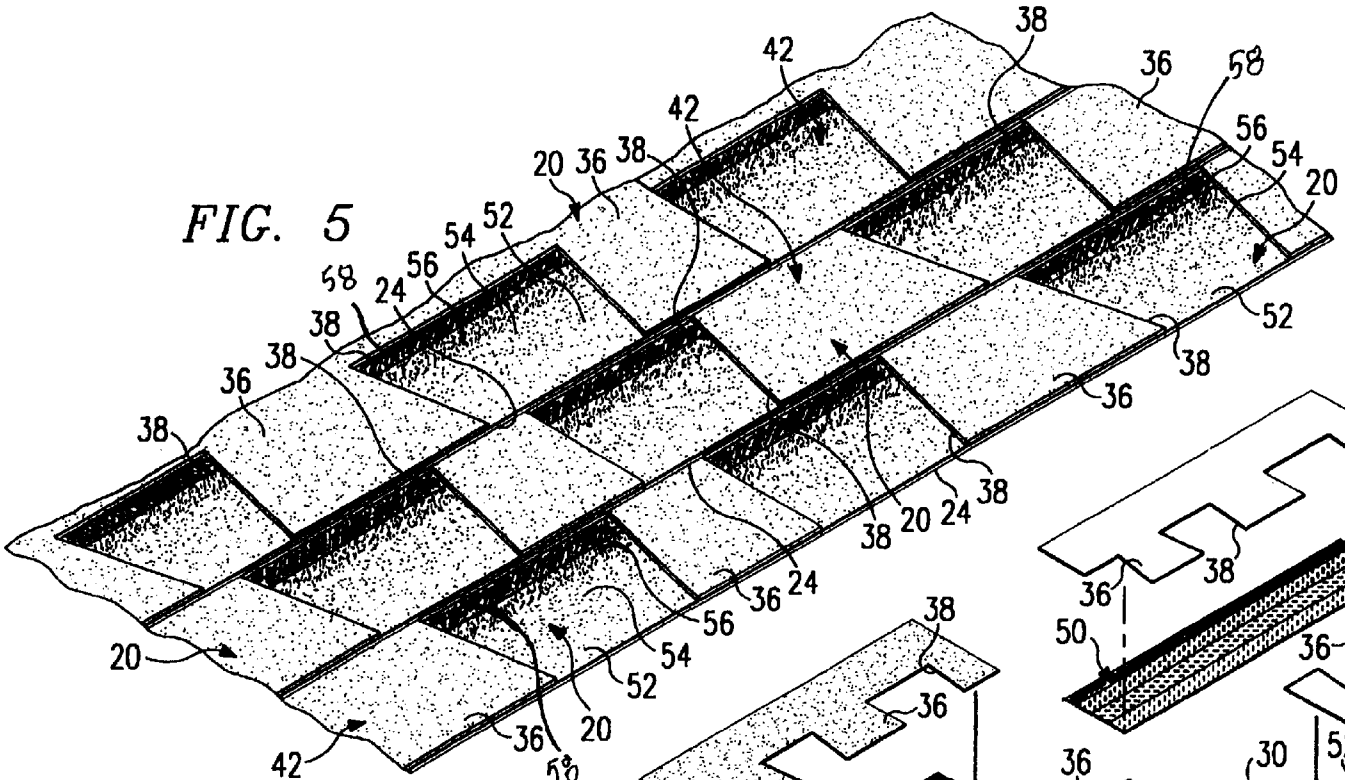
FIG. 5 is a perspective view of a partial roofing section covered with shingles incorporating one embodiment of the present invention.

As shown in FIG. 5, a plurality of laminated shingles 20 may be installed on a roof or other structure (not shown) to provide protection from the environment and to provide an aesthetically pleasing appearance. The normal installation procedure for laminated shingles 20 includes placing each shingle 20 on a roof in an overlapping configuration. Typically, buttlap section 34 of one shingle 20 will be disposed on the headlap section of another shingle 20. Self-sealing adhesive strips 40 are used to secure the overlapping shingles 20 with each other. Also, a limited lateral offset is preferably provided between horizontally adjacent rows of shingles 20 to provide an overall aesthetically pleasing appearance for the resulting roof.

Figure 7:
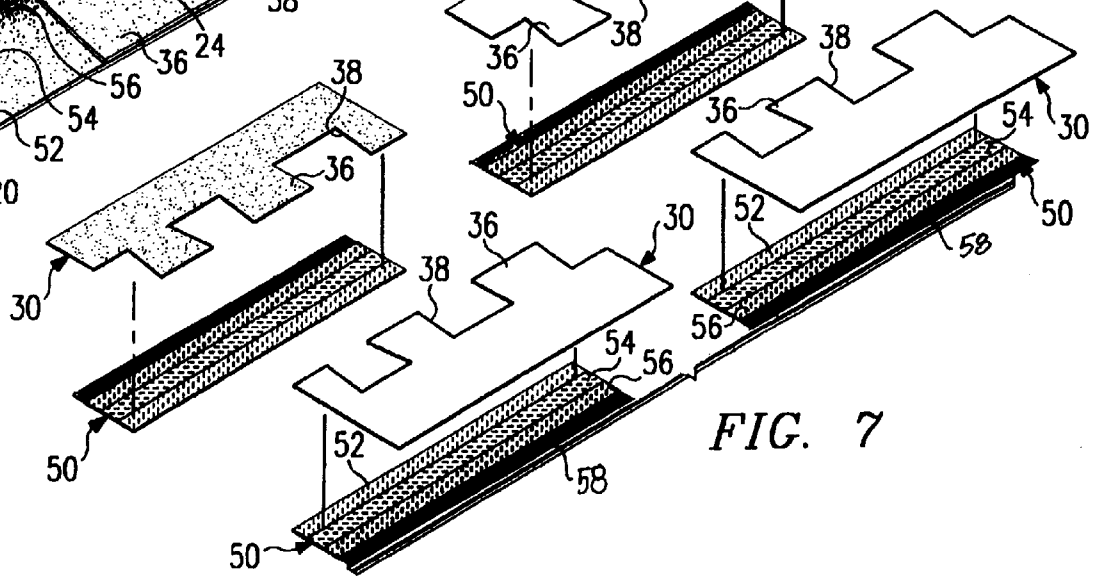
FIG. 7 is an exploded isometric view showing shingle components taken from the sheet of roofing material in FIG. 6 which may be used to form the shingle of FIG. 1.
Figure 6:
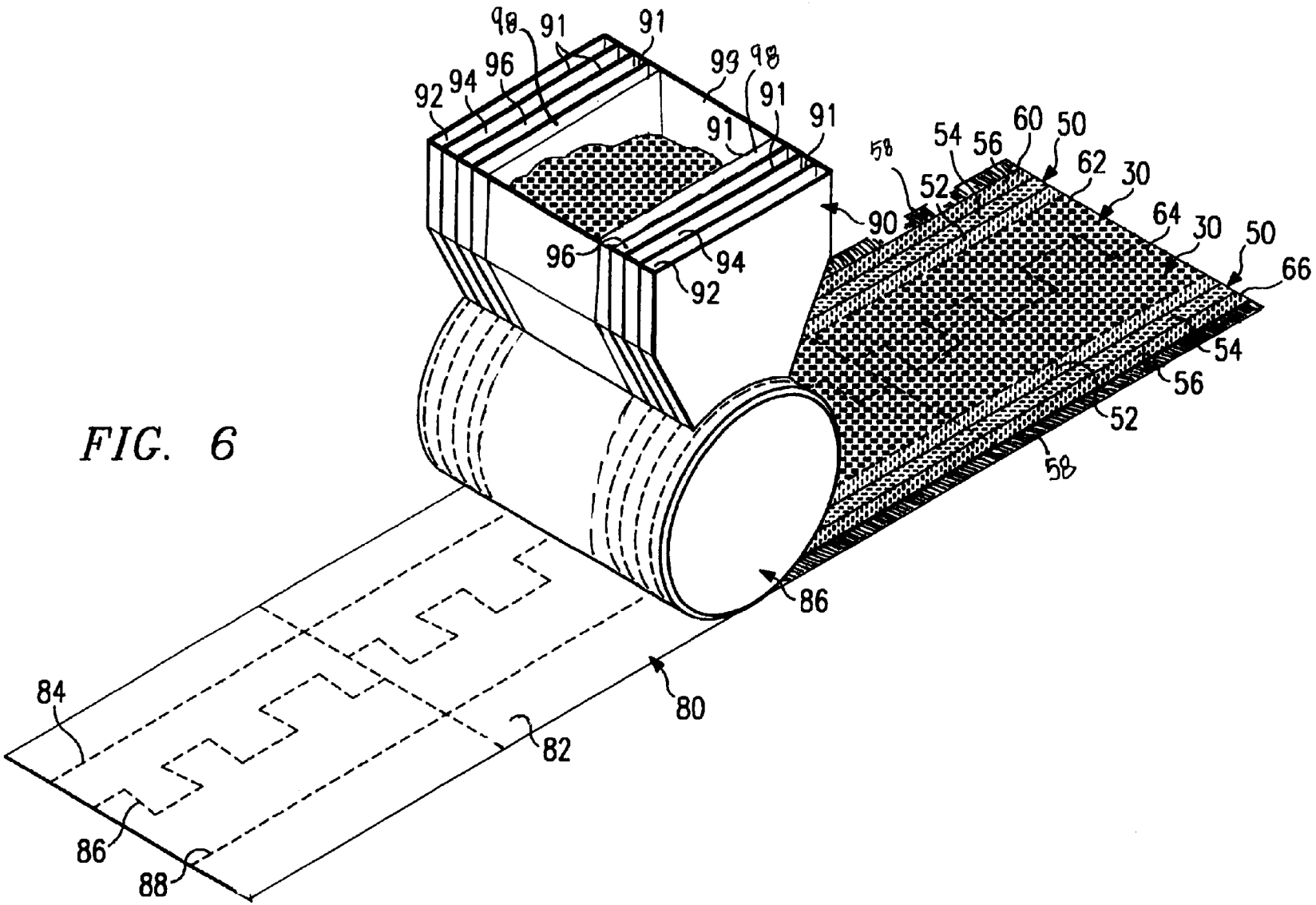
FIG. 6 is an isometric, schematic drawing of a sheet of roofing material incorporating one embodiment of the present invention from which components for the shingle of FIG. 1 may be obtained.

FIGS. 6 and 7 show one procedure for fabricating a laminated shingle 20 from a sheet 80 of roofing material. Various procedures and methods may be used to manufacture sheet 80 from which shingles incorporating the present invention may be fabricated. Examples of such procedures are contained in U.S. Pat. No. 1,722,702entitled "Roofing Shingle"; U.S. Pat. No. 3,624,975 entitled "Strip Shingle of Improved Aesthetic Character"; U.S. Pat. No. 4,399,186 entitled "Foam Asphalt Weathering Sheet for Rural Roofing Siding or Shingles"; and U.S. Pat. No. 4,405,680 entitled "Roofing Shingle." Each of these patents is incorporated by reference herein in its entirety.

Sheet 80 is preferably formed from a fiberglass mat placed on a jumbo roll (not shown) having a width corresponding to the desired sheet 80. Laminated shingles 20 are typically fabricated in a continuous process starting with the jumbo roll of fiberglass mat. As previously noted, laminated shingle 20 may also be fabricated using organic felt or other types of base material.

Sheet 80 shown in FIG. 6 preferably comprises a fiberglass mat with an asphalt coating which both coats the fibers and fills the void spaces between the fibers. A powdered mineral stabilizer (not shown) may be included as part of the asphalt coating process. A smooth surface of various inert minerals of sufficient consistency may be placed on the bottom surface of sheet 80 to seal the asphalt coating.

Top surface 82 is preferably coated with a layer of mineral granules such as ceramic coated stone granules to provide the desired uniform color portions and the color gradient portions associated with weather surface 42 of shingle 20. Typically, the mineral granules are applied to the sheet 80 while the asphalt coating is still hot and forms a tacky adhesive.

FIG. 6 shows a schematic representation of a roller 86 and mineral granule hopper 90 which may be used to provide the desired granular surface coating to sheet 80. The hopper 80, which may be any hopper which is well known in the art, includes a plurality of partitions 91 which divide the hopper 90 into three sets of compartments: a set of compartments 92, 94, 96 and 98 at each end of the hopper and a central compartment 99 between the ends. The central compartment 99 of hopper 90 contains a uniform mixture of the mineral granules which will produce the desired color on dragon teeth or tabs 36 and the other portions of first shingle sheet 30 which will be exposed to the environment. This transfer of mineral granules is sometimes referred to as a "color drop." The rotation of roller 86 and the movement of sheet 80 are coordinated to place the desired color drop on each shingle 20.

For the embodiment of the present invention shown in FIGS. 6 and 7, each first shingle sheet 30 will have the same uniform mixture of mineral granules on both the headlap section and the buttlap section. For the embodiment shown in FIGS. 1 to 4, headlap section 32 may have the same layer of mineral granules as buttlap section 34 or headlap section 32 may have a neutral or non-colored layer of mineral granules. The surface layer on headlap section 32 may be varied as desired for each application.

Different colored mineral granules corresponding to the desired color of horizontal striations 52, 54, 56, and 58 are preferably placed in the appropriate compartments 92, 94, 96, and 98, respectively. As sheet 80 passes under roller 86, mineral granules from the appropriate compartment in hopper 90 will fall onto roller 86 and will be transferred from roller 86 to top surface 82 of sheet 80. The volume or pounds per square foot of mineral granules placed on surface 82 is preferably the same throughout the full width of sheet 80. However, by dividing the hopper 90 into compartments, the color of various portions of sheet 80 may be varied including providing horizontal striations 52, 54, 56, and 58 for backer strip 50.

It is important to note that conventional procedures for fabricating shingles having an exterior surface formed by mineral granules include the use of granule blenders and color mixers, along with other sophisticated equipment to ensure a constant uniform color at each location on the exposed portions of the shingles. Extensive procedures are used to ensure that each color drop on a sheet of roofing material is uniform. The color drop between shingles may be varied to provide different shades or tones in color. However, within each color drop, concerted efforts have traditionally been made to insure uniformity of the color on the resulting shingle associated with each color drop.

Once the color drop process is complete, the sheet 80 is allowed to cool. After the sheet 80 is cooled, it is then cut. As shown by dotted lines 84, 86, and 88 in FIG. 6, sheet 80 may be cut into four horizontal lengths or lanes 60, 62, 64, and 66. The width of lanes 62 and 64 corresponds with the desired width for first shingle sheet 30. The width of lanes 60 and 66 corresponds with the desired width for second shingle sheet 50.

The cut along dotted line 86 corresponds with the desired pattern for dragon teeth 36 and associated openings 38. For some applications, more than four lanes may be cut from a sheet of roofing material similar to sheet 80. The number of lanes is dependent upon the width of the respective sheet of roofing material and the desired width of the resulting shingles.

Sheet 80 may also be cut laterally to correspond with the desired length for the resulting first shingle sheet 30 and second shingle sheet 50. As shown in FIG. 7, each lateral cut of sheet 80 results in two backer strips 50 and two first shingle sheets 30 which may be assembled with each other to form two laminated shingles 20. The resulting laminated shingles 20 may be packaged in a square for future installation on a roof as is well known in the art.

The cutting of sheet 80 and the assembly of laminated shingles 20 may be performed in a number of ways. For example, the laminated shingles 20 may be produced through an off-line lamination process in which the sheet 80 is cut both longitudinally and laterally and then the tab sheets and backer sheets which are produced are matched and attached together. Alternatively, and more preferably, the laminated shingles 20 may be produced in a continuous in-line lamination process in which the sheet 80 is cut longitudinally by a rotary die cutter, producing horizontal lengths (such as lanes 60, 62, 64, and 66) which consist of continuous tab sheet strips and backer sheet strips. The tab sheet strips and backer sheet strips are joined and adhered together to produce laminated shingle strips through means well known in the art. The laminated shingle strips may then be passed through a cutting cylinder, which cuts the strips into individual shingles. After discrete shingles are formed, they can be processed with commonly used apparatus for handling shingles, such as a shingle stacker to form stacks of shingles and a bundle packer to form shingle bundles.

It is important to note that a color gradient of the present invention may be placed on shingles using various procedures and various types of materials. The present invention is not limited to shingles formed by the process shown in FIGS. 6 and 7.

FIG. 8A is an exploded isometric view showing shingle components taken from a sheet of roofing material according to another embodiment of the present invention. In the embodiment of FIG. 8A, as better shown in FIG. 8B which is an enlarged drawing of a portion of a backer strip of FIG. 8A, transition stripes 152 and 154 are disposed between adjacent pairs 52/54 and 54/56 of the horizontal striations 52, 54 and 56. Each transition stripe has a color value that is a mixture of the colors associated with the two horizontal striations adjacent to the transition stripe. The transition stripes may be used when the difference in contrast between adjacent horizontal striations is sufficiently great that a shingle would present a confused or disjointed appearance without the transition stripes. The transition stripes may be applied as described in U.S. Pat. No. 5,611,186, which is incorporated by reference herein in its entirety.

Figure 9:
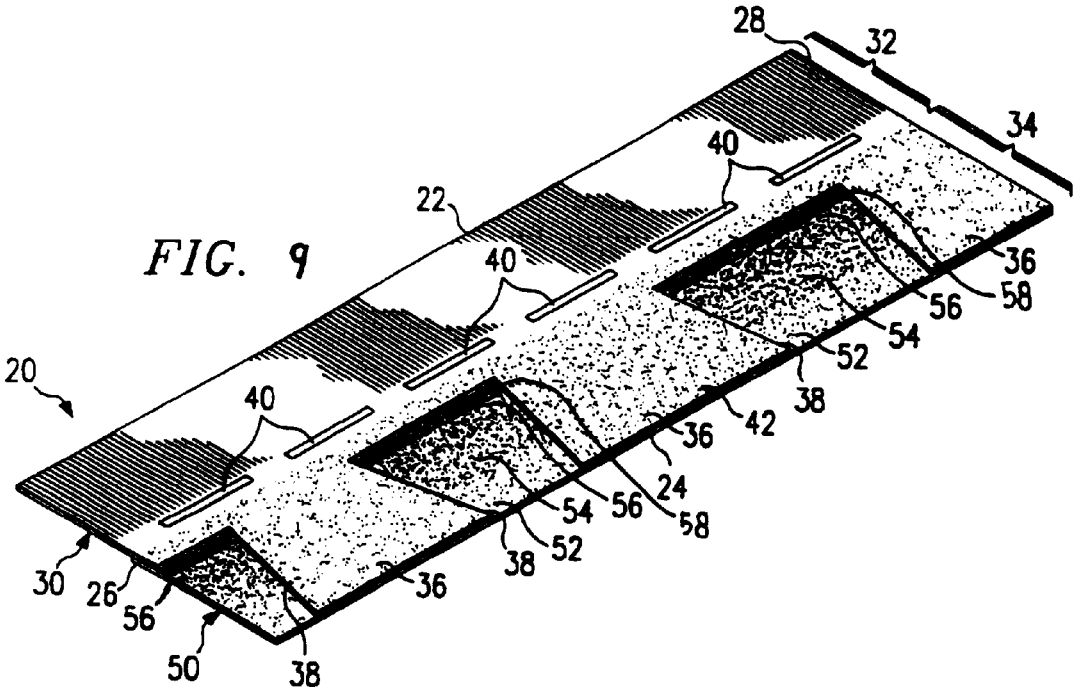
FIG. 9 is a top plan view of a laminated shingle wherein the tabs have different color contrasts from one another.

FIG. 9 illustrates a laminated shingle according to the present invention wherein the backer strip 50 has four horizontal striations 52, 54, 56 and 58, and wherein each of the tabs 36 has a relatively uniform color throughout each tab and different color contrasts between each tab.

Although the present invention has been described with reference to certain preferred embodiments, various modifications, alterations, and substitutions will be apparent to those skilled in the art without departing from the spirit and scope of the invention, as defined by the appended claims.

What is claimed is:

1. A laminated roofing shingle comprising:

a first shingle sheet having a headlap section and a buttlap section, said buttlap section being about 7 inches or greater in height and including a plurality of tabs which are spaced apart to define one or more openings between said tabs, each of said tabs having a relatively uniform color throughout the tab;

a second shingle sheet attached to the underside of said first shingle sheet and having portions exposed through said openings between said tabs; said second shingle sheet having at least first, second, third, and fourth horizontal striations thereon across at least partial portions of said second sheet which are exposed through said openings between said tabs;

said first striation comprising a first elongated quadrilateral area, said first striation having a substantially uniform dark color throughout said first quadrilateral area;

said second striation comprising a second elongated quadrilateral area below said first striation, said second striation having a substantially uniform color throughout said second quadrilateral area;

said third striation comprising a third elongated quadrilateral area below said second striation, said third striation having a substantially uniform color throughout said third quadrilateral area, said color of said third striation being lighter than said color of said second striation; and said fourth striation comprising a fourth elongated quadrilateral area below said third striation, said fourth striation having a substantially uniform color throughout said fourth quadrilateral area, said color of said fourth striation being lighter than said color of said third striation; whereby at least said second, third, and fourth striations provide a color gradation on at least partial portions of said second sheet which are exposed through said openings between said tabs.

2. The laminated roofing shingle of claim 1, wherein the color of said second striation is lighter than the color of said first striation, and at least said first, second, third, and fourth striations provide a color gradation on at least partial portions of said second sheet which are exposed through said openings between said tabs.

3. The laminated roofing shingle of claim 1, wherein the height of each of said striations is approximately equal.

4. The laminated roofing shingle of claim 3, wherein the height of each striation is in the range of one to two inches.

5. The laminated roofing shingle of claim 1, wherein said first striation is adjacent to said headlap section.

6. The laminated roofing shingle of claim 1, wherein each of said tabs have different color contrasts from one another.

7. The laminated roofing shingle of claim 1, wherein the dimensions of one of said tabs differ from the dimensions of others of said tabs.

8. The laminated roofing shingle of claim 1, further comprising a transition stripe disposed between a pair of horizontal striations having a color value comprising a mixture of the colors associated with said pair of horizontal striations.

9. The laminated roofing shingle of claim 8, wherein said mixture of the colors includes from about 25% to 75% of the color value of each of said pair of horizontal striations.

10. The laminated roofing shingle of claim 1, wherein said buttlap section is about 9 inches or less in height.

* * * * *

UNITED STATES PATENT AND TRADEMARK OFFICE

CERTIFICATE OF CORRECTION

PATENT NO. : 6,289,648 B1
DATED : September 18, 2001
INVENTOR(S) : John G. Freshwater et al.

It is certified that error appears in the above-identified patent and that said Letters Patent is hereby corrected as shown below:

Title page,
Item [56], References Cited, U.S. PATENT DOCUMENTS, insert:
-- OTHER PUBLICATIONS
Elk Prestique® & Prestique II® Brochure (4 pages) (admitted prior art).
"Roofing CertainTeed: Overview" web site (http://www.certainteed.com/pro/roofing/ctroof/overview.html) printed May 13, 1999 (2 pages). --

Column 1,
Line 67, "very" should read -- vary --

Column 3,
Line 9, "glueing" should read -- gluing --

Column 5,
Line 17, "1,722,707entitled" should read -- 1,722,707 entitled --

Signed and Sealed this

Ninth Day of September, 2003

JAMES E. ROGAN
*Director of the United States Patent and Trademark Office*